US005839838A

United States Patent [19]

Hokamura et al.

[11] Patent Number: 5,839,838

[45] Date of Patent: Nov. 24, 1998

[54] IMAGE PRINTER

[75] Inventors: Tetsuya Hokamura, Osaka; Masami Nakagawa, Hirakata; Takayuki Kawamura, Kadoma; Takashi Koike, Katano, all of Japan

[73] Assignee: Matsushita Electric Industrial Co., Ltd., Osaka, Japan

[21] Appl. No.: 956,124

[22] Filed: Oct. 22, 1997

[30] Foreign Application Priority Data

| | | | |
|---|---|---|---|
| Oct. 25, 1996 | [JP] | Japan | 8-283613 |
| Oct. 30, 1996 | [JP] | Japan | 8-287883 |
| Apr. 30, 1997 | [JP] | Japan | 9-112188 |
| Apr. 30, 1997 | [JP] | Japan | 9-112189 |

[51] Int. Cl.[6] ..... B41J 23/34

[52] U.S. Cl. ..... 400/185; 400/186

[58] Field of Search ..... 400/185, 578, 400/186

[56] References Cited

U.S. PATENT DOCUMENTS

| | | | |
|---|---|---|---|
| 5,184,902 | 2/1993 | Harada et al. | 400/185 |
| 5,531,527 | 7/1996 | Maekawa et al. | 400/185 |
| 5,564,842 | 10/1996 | Kida et al. | 400/185 |
| 5,743,661 | 4/1998 | Tamura | 400/55 |

*Primary Examiner*—Edgar S. Burr
*Assistant Examiner*—Dave A. Ghatt
*Attorney, Agent, or Firm*—Wenderoth, Lind & Ponack, L.L.P.

[57] ABSTRACT

An image printer comprising: a printing member for printing dye on a recording medium; a dye medium take-up member for taking up a dye medium to which the dye is applied; a first power transmission member for transmitting power to the dye medium take-up member; a recording medium transporting member for transporting the recording medium; a drive member for driving the dye medium take-up member and the recording medium transporting member, which can be driven forwardly and reversely; a pivotal member which is pivotal in response to rotation of the recording medium transporting member; a second power transmission member for transmitting power from the recording medium transporting member to the first power transmission member, which is mounted on the pivotal member; an urging member for bringing the recording medium transporting member into contact with the pivotal member so as to transmit driving force of the recording medium transporting member to the pivotal member; and a preventive member for selectively preventing the second power transmission member from coming into contact with the first power transmission member.

4 Claims, 12 Drawing Sheets

IMAGE PRINTER

BACKGROUND OF THE INVENTION

The present invention relates to a heat transfer type image printer for recording various information such as images on recording paper sheets.

Recently, image printers capable of recording various image signals on recording paper sheets in full color are commercially available. FIGS. 1A and 1B show a front of a known image printer. In FIGS. 1A and 1B, an ink sheet 1 has rectangular ink application portions to which inks of three primary colors of yellow, magenta and cyan for printing are, respectively, applied as viewed from a take-up side of the ink sheet 1 such that an ink nonapplication portion is provided between neighboring ones of the ink application portions. The ink sheet 1 before use is wound around a supply reel 2, while the ink sheet 1 after use is taken up by a take-up reel 3. An ink cassette 4 is provided between the supply reel 2 and the take-up reel 3 so as to hold the supply reel 2 and the take-up reel 3. Heat transfer recording is performed on a recording paper sheet 6 by a thermal head 5. The ink sheet 1 and the recording paper sheet 6 are gripped between the thermal head 5 and a platen roller 7. A pinch roller 9 brings the recording paper sheet 6 into pressing contact with a capstan roller 8 for feeding the recording paper sheet 6. A light emitting element 10 and a photosensor 11 are provided for detecting positions of the ink application portions of the three colors in the ink sheet 1.

Meanwhile, FIG. 2 shows a rear of the known image printer of FIG. 1. In FIG. 2, a capstan driving pulley 12 is mounted on a rotary shaft of the capstan roller 8. A pulley 14 is mounted on a rotary shaft of a paper feeding motor 13. A power transmission belt 15 for transmitting driving force of the pulley 14 to the capstan driving pulley 12 is trained over the capstan driving pulley 12 and the pulley 14. A reel driving gear 16 for driving the take-up reel 3 is held coaxially with the take-up reel 3. A gear 18 for transmitting driving force of a sheet feeding motor 17 to the reel driving gear 16 is mounted on a rotary shaft of the sheet feeding motor 17.

Hereinafter, operation of the known image printer of the above described arrangement is described. Initially, if the paper feeding motor 13 is rotated in a state where the thermal head 5 is retracted away from the platen roller 7 as shown in FIG. 1A, the capstan roller 8 is rotated through the pulley 14, the power transmission belt 15 and the capstan driving pulley 12. As a result, the recording paper sheet 6 is transported to a predetermined position. Meanwhile, if the sheet feeding motor 17 is rotated, the take-up reel 3 is rotated via the gear 18 and the reel driving gear 16. As a result, the ink sheet 1 is supplied from the supply reel 2 so as to be conveyed to a predetermined position.

Then, as shown in FIG. 1B, the thermal head 5 is displaced downwardly so as to depress the ink sheet 1 and the recording paper sheet 6 against the platen roller 7. In this state, the paper feeding motor 13 and the sheet feeding motor 17 are rotated simultaneously. As a result, voltage is applied to the thermal head 5 while the capstan roller 8 and the take-up reel 3 are being transported by rotating the capstan roller 8 and the take-up reel 3. By repeating the above operation three times for the three primary colors of printing, a predetermined full color image is printed on the recording paper sheet 6.

Finally, the thermal head 5 is displaced upwardly so as to be spaced away from the ink sheet 1 and the capstan roller 8 is rotated so as to feed the recording paper sheet 6 leftwards such that the recording paper sheet 6 is ejected out of the known image printer.

However, in the known image printer of the above described arrangement, two driving sources for transporting the ink sheet 1 and the recording paper sheet 6, namely, the sheet feeding motor 17 and the paper feeding motor 13 which are expensive components of the mechanism are required to be provided. Therefore, due to the need for employing the motors 17 and 13, the known image printer becomes high in production cost and large in size disadvantageously.

Meanwhile, FIGS. 3A to 3C show a front of another prior art image printer. In this prior art image printer, the light emitting element 10 and the photosensor 11 of the known image sensor of FIG. 1A are replaced by a light emitting and receiving element 10' and a reflector 11', respectively. Meanwhile, FIG. 4 shows a rear of the prior art image printer. In FIG. 4, a gear 60 for driving the supply reel 2 and a cam gear 61 for bringing the thermal head 5 into and out of pressing contact with the platen roller 7 by way of a retaining member and a drive member and a slack eliminating idler gear 62 for transmitting driving force of the cam gear 60 to the gear 60 are provided such that a slack eliminating mechanism for eliminating slack of the ink sheet 1 is constituted by the gear 60, the cam gear 61 and the slack eliminating idler gear 62 as described below. Since other constructions of this prior art image printer are similar to those of the known image printer of FIG. 1A, the description is abbreviated for the sake of brevity.

Hereinafter, operation of the prior art image printer of the above described arrangement is described. When the cam gear 61 is rotated in the direction of the arrow J in FIG. 4 so as to lift the thermal head 5 from the depressed state in which the thermal head 5 is depressed against the platen roller 7 to the retractive state in which the ink cassette 4 can be mounted on or removed from the prior art image printer, the slack eliminating idler gear 62 is rotated in the direction of the arrow I in FIG. 4 and thus, the gear 60 is rotated in the direction of the arrow A in FIG. 4. Consequently, the ink sheet 1 drawn by the thermal head 5 is wound around the supply reel 2 so as to eliminate slack of the ink sheet 1.

In the above prior art image printer, the complicated slack eliminating mechanism is required to be provided for eliminating slack of the ink sheet 1 produced at the time the thermal head 5 is brought into and out of pressing contact with the ink sheet 1. Therefore, in addition to the above mentioned disadvantage of the known image printer of FIG. 1A, the prior art image printer of FIG. 3A has such drawbacks that it is further difficult to make the known image printer compact and lower production cost of the known image printer.

SUMMARY OF THE INVENTION

Accordingly, an essential object of the present invention is to provide, with a view to eliminating the above mentioned disadvantages of prior art, an image printer which can be easily produced at low cost and made compact and light.

In order to accomplish this object of the present invention, an image printer according to the present invention comprises: a printing means for printing dye on a recording medium; a dye medium take-up means for taking up a dye medium to which the dye is applied; a first power transmission means for transmitting power to the dye medium take-up means; a recording medium transporting means for transporting the recording medium; a drive means for driving the dye medium take-up means and the recording medium transporting means, which can be driven forwardly and reversely; a pivotal means which is pivotal in response to rotation of the recording medium transporting means; a second power transmission means for transmitting power from the recording medium transporting means to the first power transmission means, which is mounted on the pivotal means; an urging means for bringing the recording medium transporting means into contact with the pivotal means so as to transmit driving force of the recording medium transporting means to the pivotal means; and a preventive means for selectively preventing the second power transmission means from coming into contact with the first power transmission means; wherein when the drive means is driven in a first direction, driving force of the drive means is transmitted to the recording medium transporting means so as to not only transport the recording medium in a first direction but pivot the pivotal means towards the first power transmission means through the recording medium transporting means, whereby the second power transmission means is brought into contact with the first power transmission means so as to drive the dye medium take-up means by power of the drive means such that the dye medium is taken up by the dye medium take-up means; wherein when the drive means is driven in a second direction, driving force of the drive means is transmitted to the recording medium transporting means so as to not only transport the recording medium in a second direction but pivot the pivotal means away from the first power transmission means through the recording medium transporting means, whereby the second power transmission means is spaced away from the first power transmission means such that the dye medium take-up means is not driven.

By this arrangement of the image printer of the present invention, when a capstan roller is rotated in a retractive state of a thermal head in a direction for transporting a recording paper sheet from paper feeding and discharging portions towards a recording portion, an idler lever is rotated so as to disengage an idler gear from a real driving gear. Thus, only the recording paper sheet is transported to a predetermined position in a stop state of an ink sheet. Subsequently, when the capstan roller is rotated in a direction for transporting the recording paper sheet 6 from the recording portion towards the paper feeding and discharging portions, the idler lever is rotated so as to bring the idler gear into engagement with the reel driving gear. Therefore, simultaneously with feed of the recording paper sheet, the ink sheet is transported to a predetermined position. Then, only the recording paper sheet is transported to a predetermined position in a stop state of the ink sheet again. Thereafter, when the thermal head is pressed against a platen roller so as to grip the recording paper sheet and the ink sheet between the thermal head and the platen roller and the capstan roller is rotated in the direction for transporting the recording paper sheet from the recording portion towards the paper feeding and discharging portions, the idler lever is rotated so as to bring the idler gear into engagement with the reel driving gear. As a result, the recording paper sheet and the ink sheet are transported simultaneously and a predetermined image is printed on the recording paper sheet by applying voltage to the thermal head. Then, by repeating transport of the ink sheet, transport of the recording paper sheet and printing operation in the same manner as described above, a full color image is printed on the recording paper sheet. Upon completion of final printing operation, the thermal head is retracted and the idler gear is disengaged from the reel driving gear by the means for preventing rotation of the idler lever. Then, when the capstan roller is rotated in the direction for transporting the recording paper sheet from the recording portion toward the paper feeding and discharging portions, only the recording paper sheet is discharged to the paper discharging portion.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1A:
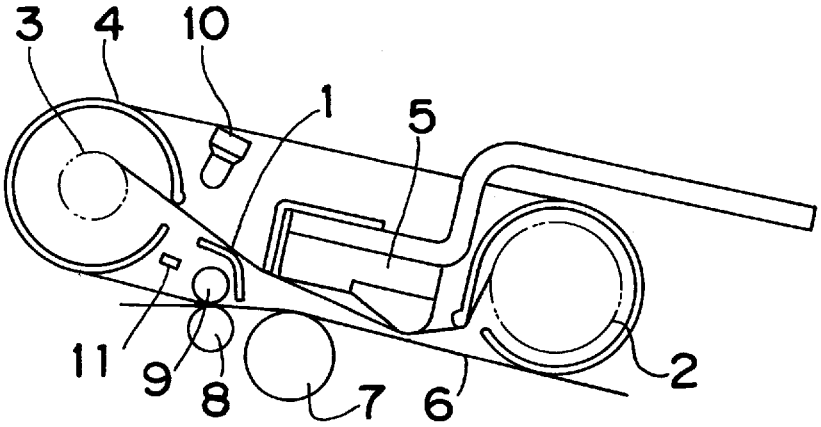
Fig. 1A PRIOR ART
FIGS. 1A and 1B are fragmentary front elevational views of a prior art image printer in its two operational steps, respectively (already referred to)
Figure 1B:
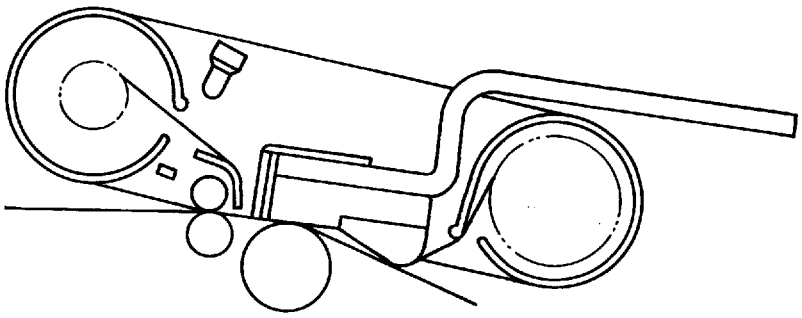
Fig. 1B PRIOR ART
Figure 2:
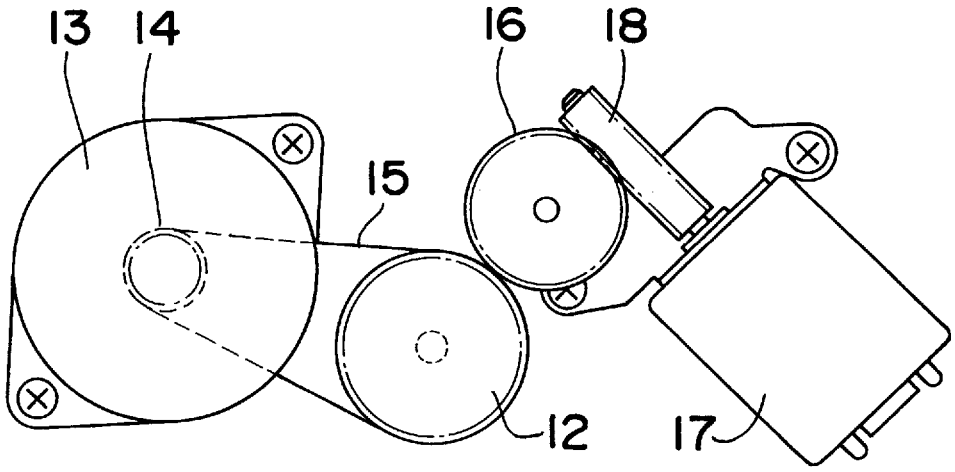
Fig. 2 PRIOR ART
FIG. 2 is a fragmentary rear elevational view of the prior art image printer of FIG. 1A (already referred to)
Figure 3A:
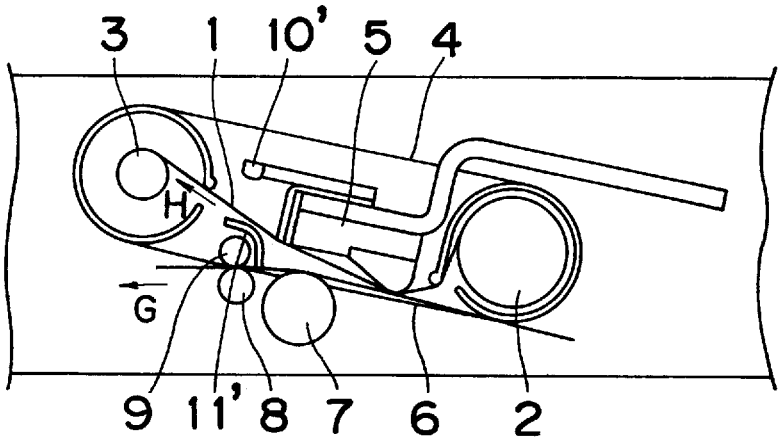
Fig.3A PRIOR ART
FIGS. 3A, 3B and 3C are fragmentary front elevational views of another prior art image printer in its three operational steps, respectively (already referred to)
Figure 3B:
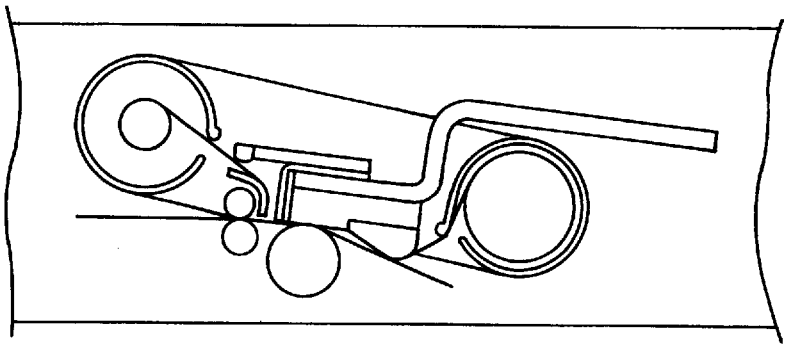
Fig.3B PRIOR ART
Figure 3C:
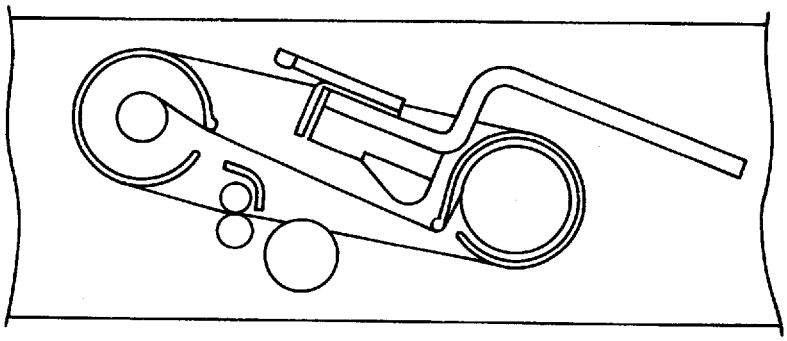
Fig.3C PRIOR ART
Figure 4:
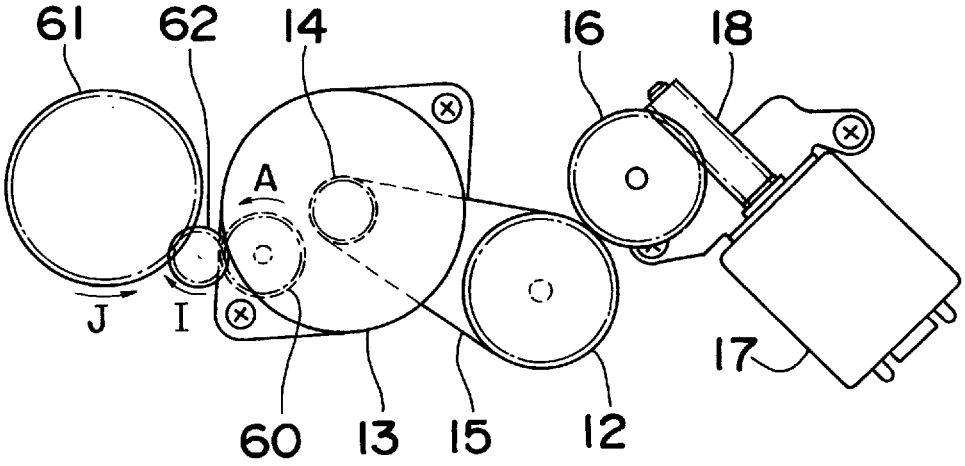
Fig.4 PRIOR ART
FIG. 4 is a fragmentary rear elevational view of the prior art image printer of FIG. 3A (already referred to)
Figure 5A:
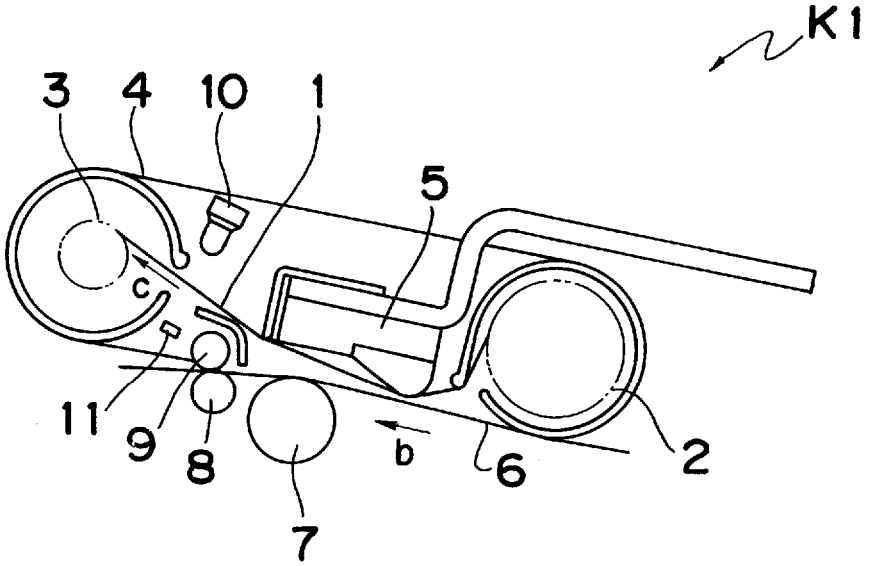
FIGS. 5A and 5B are fragmentary front elevational views of an image printer according to a first embodiment of the present invention in its two operational steps, respectively.
Figure 5B:
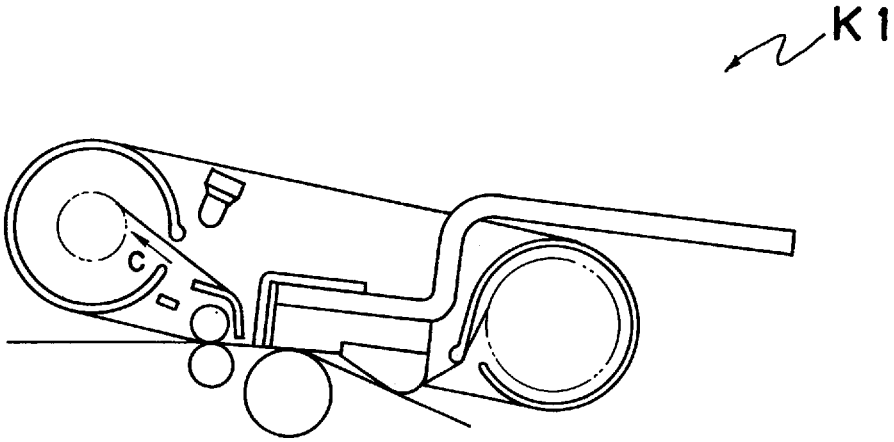

Referring now to the drawings, FIGS. 5A and 5B show a front of an image printer K1 according to a first embodiment of the present invention. In FIGS. 5A and 5B, inks of three primary colors of yellow, magenta and cyan for printing are, respectively, applied to rectangular ink application portions of an ink sheet 1 as viewed from a take-up side of the ink sheet 1 such that an ink nonapplication portion is provided between neighboring ones of the ink application portions. Thus, the ink sheet 1 acts a dye medium. The ink sheet 1 before use is wound around a supply reel 2, while the ink sheet 1 after use is taken up by a take-up reel 3. Thus, the supply reel 2 acts as a dye medium supply means, while the take-up reel 3 acts as a dye medium take-up means. An ink cassette 4 is formed by a housing and is provided between the supply reel 2 and the take-up reel 3 so as to hold the supply reel 2 and the take-up reel 3. A recording paper sheet 6 acts as a recording medium, while a thermal head 5 acts as a printing means. Heat transfer recording is performed on the recording paper sheet 6 by the thermal head 5 upon supply of voltage to the thermal head 5. The ink sheet 1 and the recording paper sheet 6 are gripped between the thermal head 5 and a platen roller 7 acting as a grip means. A pinch roller 9 brings the recording paper sheet 6 into pressing contact with a capstan roller 8 acting as a recording medium transporting means for transporting the recording paper sheet 6. A light emitting element 10 and a photosensor 11 are provided for detecting positions of the ink application portions of the ink sheet 1.

Figure 6A:
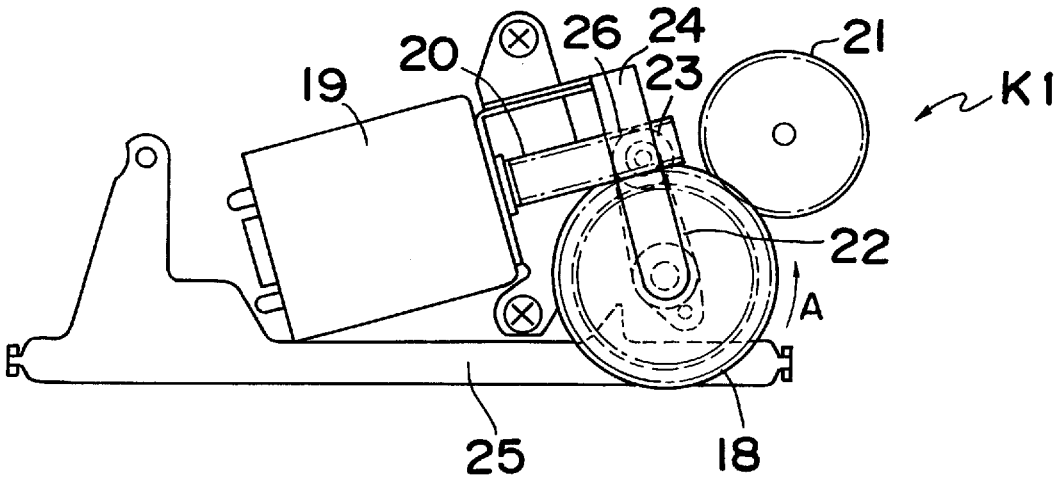
FIGS. 6A, 6B and 6C are fragmentary rear elevational views of the image printer of FIG. 5A in its three operational steps, respectively.
Figure 6B:
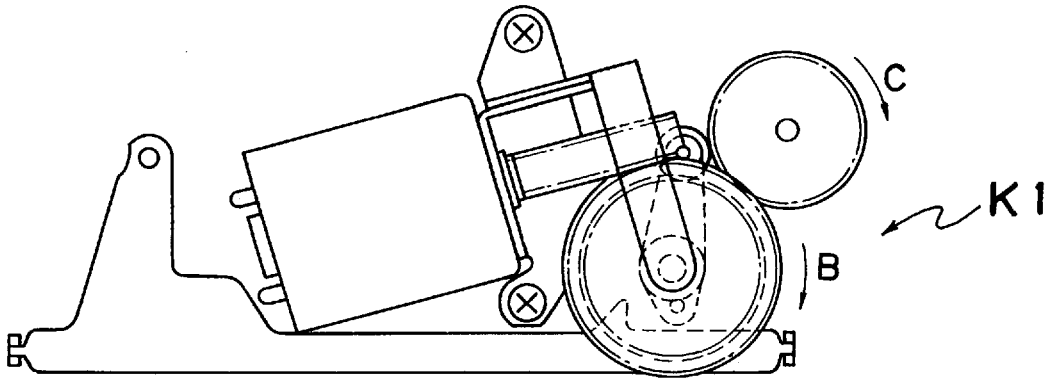
Figure 6C:
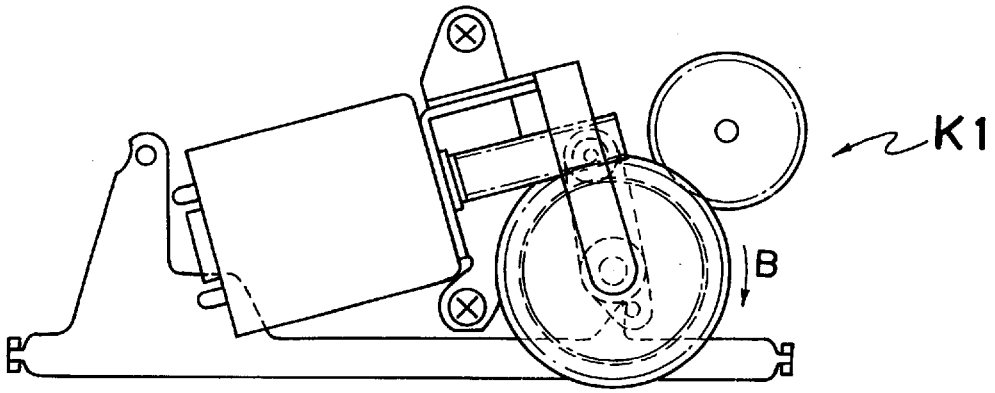

FIGS. 6A to 6C show a rear of the image printer K1. A capstan driving gear 18 acting as the recording medium transporting means is mounted on a rotary shaft of the capstan roller 8. A motor 19, for example, a DC motor acts a drive means. A worm 20 also acts as the drive means and is mounted on a rotary shaft of the motor 19. A reel driving gear 21 for driving the take-up reel 3 is held coaxially with the take-up reel 3. An idler lever 22 is pivotally mounted on a rotary shaft of the capstan driving gear 18 so as to act as a pivotal means. An idler gear 23 acting as a power transmission means is held by the idler lever 22 and is engageable with the capstan driving gear 18 and the reel driving gear 21. A thrust imparting spring 24 acting as an urging means is provided for urging the capstan driving gear 18 towards the idler lever 22. A rod 25 for preventing pivotal movement of the idler lever 22 is slidably provided so as to be brought into and out of contact with the idler lever 22. A stopper 26 for preventing pivotal movement of the idler lever 22 is secured to a frame of the image printer K1. A first preventive means for preventing pivotal movement of the idler lever 22 is constituted by the rod 25 and the stopper 26.

Hereinafter, operation of the image printer K1 of the above described arrangement is described. Initially, when the motor 19 is rotated forwardly in a state where the thermal head 5 is spaced away from the ink sheet 1 as shown in FIG. 5A, the capstan driving gear 18 is rotated via the worm 20 in the direction of the arrow A as shown in FIG. 6A. Rotational force of the capstan driving gear 18 is transmitted to the idler lever 22 through frictional force produced upon contact made therebetween by urging force of the thrust imparting spring 24. Thus, the idler lever 22 is pivoted and is stopped at the stopper 26. Therefore, only the recording paper sheet 6 is transported to a predetermined position in a stop state of the ink sheet 1.

Subsequently, when the motor 19 is rotated reversely in a state where the thermal head 5 is retracted upwardly as shown in FIG. 5A, the capstan driving gear 18 is rotated via the worm 20 in the direction of the arrow B as shown in FIG. 6B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow C in FIG. 6B. As a result, simultaneously with feed of the recording paper sheet 6 in the direction of the arrow b in FIG. 5A, the ink sheet 1 is transported in the direction of the arrow c in FIG. 5A to a predetermined position, i.e., a leading position of the ink application portion for the ink of yellow. At this time, the predetermined position to which the ink sheet 1 should be transported is detected by the light emitting element 10 and the photosensor 11.

Then, when the motor 19 is rotated forwardly in a state where the thermal head 5 is retracted upwardly as shown in FIG. 5A, the capstan driving gear 18 is rotated in the direction of the arrow A as shown in FIG. 6A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. Therefore, only the recording paper sheet 6 is transported to a predetermined position (print starting position) in a stop state of the ink sheet 1.

Thereafter, the thermal head 5 is pressed against the platen roller 7 as shown in FIG. 5B. Then, when the motor 19 is rotated reversely, the capstan driving gear 18 is driven through the worm 20 in the direction of the arrow B as shown in FIG. 6B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow C as shown in FIG. 6B. As a result, the recording paper sheet 6 is fed through a length of an image to a predetermined position in the direction of the arrow b as shown in FIG. 5A while the ink sheet 1 is being transported in the direction of the arrow c. At this time, a predetermined voltage is applied to the thermal head 5 and thus, a predetermined image in yellow is printed on the recording paper sheet 6.

Then, the thermal head 5 is retracted upwardly as shown in FIG. 5A. When the motor 19 is rotated reversely, the capstan driving gear 18 is rotated via the worm 20 in the direction of the arrow B as shown in FIG. 6B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow C in FIG. 6B. As a result, simultaneously with feed of the recording paper sheet 6 in the direction of the arrow b in FIG. 5A, the ink sheet 1 is transported in the direction of the arrow c in FIG. 5A to a predetermined position, i.e., a leading position of the ink application portion for the ink of magenta. At this time, the predetermined position to which the ink sheet 1 should be transported is detected by the light emitting element 10 and the photosensor 11.

Then, when the motor 19 is rotated forwardly in a state where the thermal head 5 is retracted upwardly as shown in FIG. 5A, the capstan driving gear 18 is rotated in the direction of the arrow A as shown in FIG. 6A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. Therefore, only the recording paper sheet 6 is transported to a predetermined position (print starting position) in a stop state of the ink sheet 1.

Thereafter, the thermal head 5 is pressed against the platen roller 7 as shown in FIG. 5B. Then, when the motor 19 is rotated reversely, the capstan driving gear 18 is driven through the worm 20 in the direction of the arrow B as shown in FIG. 6B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow C as shown in FIG. 6B. As a result, the recording paper sheet 6 is fed through a length of an image to a predetermined position in the direction of the arrow b as shown in FIG. 5A while the ink sheet 1 is being transported in the direction of the arrow c. At this time, a predetermined voltage is applied to the thermal head 5 and thus, a predetermined image in magenta is printed on the recording paper sheet 6.

Then, the thermal head 5 is retracted upwardly as shown in FIG. 5A. When the motor 19 is rotated reversely, the capstan driving gear 18 is rotated via the worm 20 in the direction of the arrow B as shown in FIG. 6B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow C in FIG. 6B. As a result, simultaneously with feed of the recording paper sheet 6 in the direction of the arrow b in FIG. 5A, the ink sheet 1 is transported in the direction of the arrow c in FIG. 5A to a predetermined position, i.e., a leading position of the ink application portion for the ink of cyan. At this time, the predetermined position to which the ink sheet 1 should be transported is detected by the light emitting element 10 and the photosensor 11.

Then, when the motor 19 is rotated forwardly in a state where the thermal head 5 is retracted upwardly as shown in FIG. 5A, the capstan driving gear 18 is rotated in the direction of the arrow A as shown in FIG. 6A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. Therefore, only the recording paper sheet 6 is transported to a predetermined position (print starting position) in a stop state of the ink sheet 1 as shown in FIG. 5A.

Thereafter, the thermal head 5 is pressed against the platen roller 7 as shown in FIG. 5B. Then, when the motor 19 is rotated reversely, the capstan driving gear 18 is driven through the worm 20 in the direction of the arrow B as shown in FIG. 6B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow C as shown in FIG. 6B. As a result, the recording paper sheet 6 is fed through a length of an image to a predetermined position in the direction of the arrow b as shown in FIG. 5A while the ink sheet 1 is being transported in the direction of the arrow c. At this time, a predetermined voltage is applied to the thermal head 5 and thus, a predetermined image in cyan is printed on the recording paper sheet 6.

By the above described operation, a full color image is printed on the recording paper sheet 6. Finally, the thermal head 5 is retracted upwardly as shown in FIG. 5A. Then, the rod 25 is displaced to a position where the rod 25 can be brought into contact with the idler lever 22 as shown in FIG. 6C. When the motor 19 is rotated reversely in this state, the capstan driving gear 18 is rotated in the direction of the arrow B via the worm 20 as shown in FIG. 6C. Rotational force of the capstan driving gear 18 is transmitted to the idler lever 22 through frictional force produced upon contact made therebetween by urging force of the thrust imparting spring 24. The idler lever 22 is pivoted and is stopped through its contact with the rod 25. Therefore, the reel driving gear 21 and the idler gear 23 are brought out of engagement with each other. Accordingly, only the recording paper sheet 6 is transported in the direction of the arrow b as shown in FIG. 5A in a stop state of the ink sheet 1. Thus, the recording paper sheet 6 is ejected out of the image printer K1.

Figure 7A:
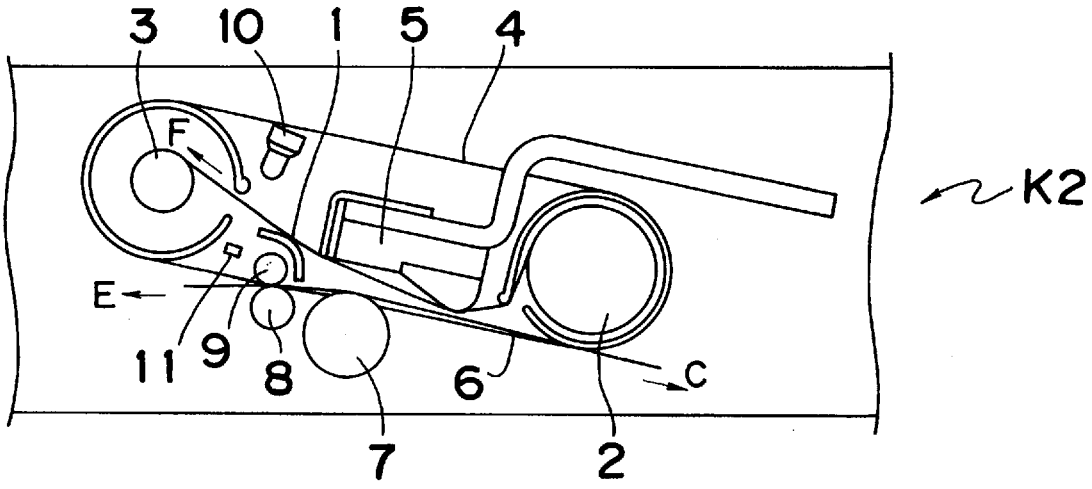
FIGS. 7A and 7B are fragmentary front elevational views of an image printer according to a second embodiment of the present invention in its two operational steps, respectively.
Figure 7B:
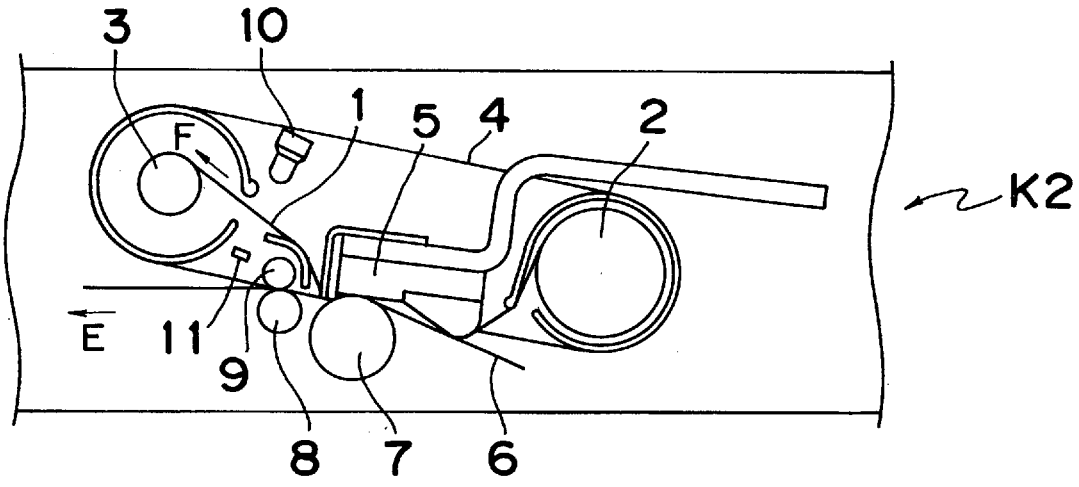
Figure 8A:
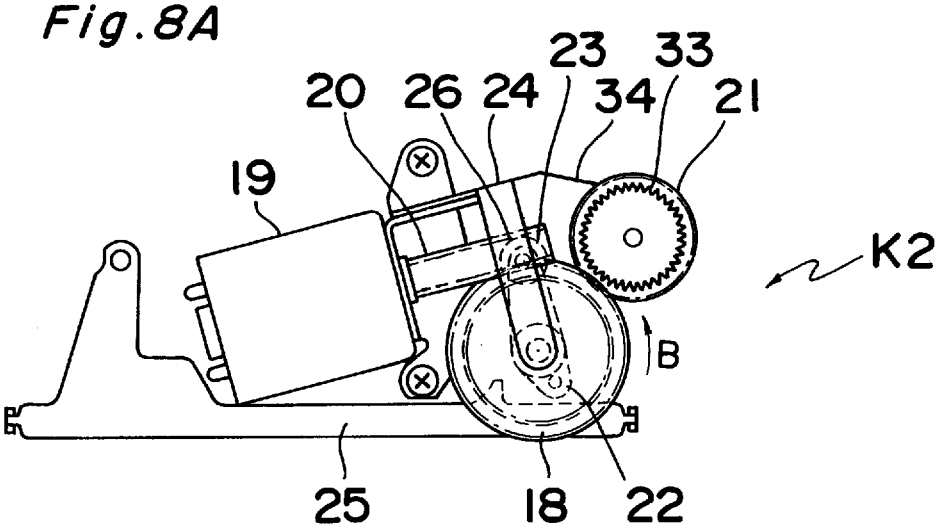
FIGS. 8A, 8B and 8C are fragmentary rear elevational views of the image printer of FIG. 7A in its three operational steps, respectively.
Figure 8B:
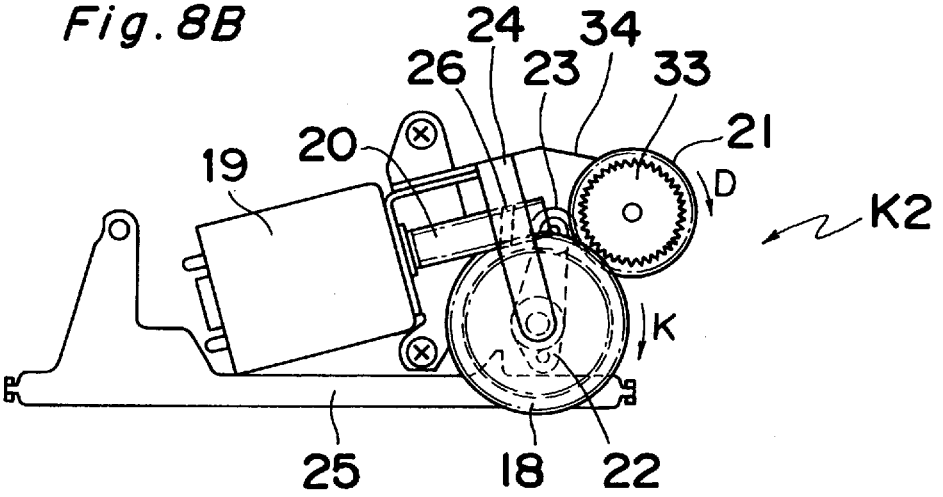
Figure 8C:
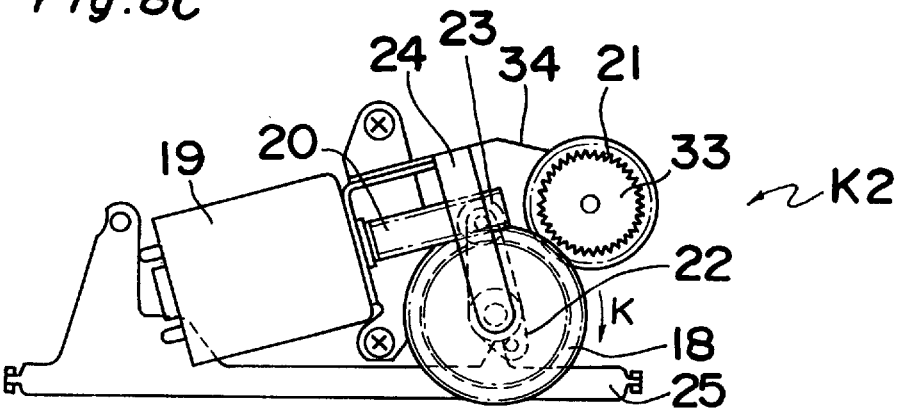

FIGS. 7A and 7B show a front of an image printer K2 according to a second embodiment of the present invention, while FIGS. 8A to 8C show a rear of the image printer K2. Since the front of the image printer K2 is structurally the same as that of the image printer K1, the image printer K2 is described mainly with reference to FIGS. 8A to 8C, hereinafter. The image printer K2 includes a reel latch 33 and a latch spring 34. The reel latch 33 is directly coupled with the reel driving gear 21 and is formed, on its outer periphery, with a plurality of teeth. The latch spring 34 is engageable with the teeth of the reel latch 33. When the latch spring 34 is held in engagement with the teeth of the reel latch 33, counterclockwise rotation of the reel latch 33 is prevented. Thus, a second preventive means for preventing counterclockwise rotation of the reel latch 33 is constituted by the reel latch 33 and the latch spring 34. Since other constructions of the image printer K2 are similar to those of the image printer K1, the description is abbreviated for the sake of brevity.

Hereinafter, operation of the image printer K2 of the above described arrangement is described. Initially, when the motor 19 is rotated forwardly in a state where the thermal head 5 is retracted upwardly as shown in FIG. 7A, the capstan driving gear 18 is rotated via the worm 20 in the direction of the arrow B as shown in FIG. 8A. Rotational force of the capstan driving gear 18 is transmitted to the idler lever 22 through frictional force produced upon contact made therebetween by urging force of the thrust imparting spring 24. Thus, the idler lever 22 is pivoted and is stopped at the stopper 26. Meanwhile, stop state of the reel driving gear 21 is maintained by the latch spring 34 held in engagement with the reel latch 33. Therefore, only the recording paper sheet 6 is transported to a predetermined position in the direction of the arrow C as shown in FIG. 7A in a stop state of the ink sheet 1.

Subsequently, when the motor 19 is rotated reversely, the capstan driving gear 18 is rotated via the worm 20 in the direction of the arrow K as shown in FIG. 8B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow D in FIG. 8B. At this time, the reel latch 33 is also rotated upon its disengagement from the latch spring 34. As a result, simultaneously with feed of the recording paper sheet 6 in the direction of the arrow E in FIG. 7A, the ink sheet 1 is transported in the direction of the arrow F in FIG. 7A to a predetermined position, i.e., a leading position of the ink application portion for the ink of yellow. At this time, the predetermined position to which the ink sheet 1 should be transported is detected by the light emitting element 10 and the photosensor 11.

Then, when the motor 19 is rotated forwardly, the capstan driving gear 18 is rotated in the direction of the arrow B as shown in FIG. 8A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. Meanwhile, stop state of the reel driving gear 21 is maintained by the latch spring 34 held in engagement with the reel latch 33. Therefore, only the recording paper sheet 6 is transported to a predetermined position (print starting position) in the direction of the arrow C in FIG. 7A in a stop state of the ink sheet 1.

Thereafter, the thermal head 5 is pressed against the platen roller 7 as shown in FIG. 7B. Then, when the motor 19 is rotated reversely, the capstan driving gear 18 is driven through the worm 20 in the direction of the arrow K as shown in FIG. 8B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow D as shown in FIG. 8B. At this time, the reel latch 34 is also rotated upon its disengagement from the latch spring 34. As a result, the recording paper sheet 6 is fed through a length of an image to a predetermined position in the direction of the arrow E as shown in FIG. 7B while the ink sheet 1 is being transported in the direction of the arrow F. At this time, a predetermined voltage is applied to the thermal head 5 and thus, a predetermined image in yellow is printed on the recording paper sheet 6.

Then, the thermal head 5 is retracted upwardly as shown in FIG. 7A. When the motor 19 is rotated reversely, the capstan driving gear 18 is rotated via the worm 20 in the direction of the arrow K as shown in FIG. 8B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow D in FIG. 8B. At this time, the reel latch 33 is also rotated upon its engagement from the latch spring 34. As a result, simultaneously with feed of the recording paper sheet 6 in the direction of the arrow E in FIG. 7A, the ink sheet 1 is transported in the direction of the arrow E in FIG. 7A to a predetermined position, i.e., a leading position of the ink application portion for the ink of magenta. At this time, the predetermined position to which the ink sheet 1 should be transported is detected by the light emitting element 10 and the photosensor 11.

Then, when the motor 19 is rotated forwardly, the capstan driving gear 18 is rotated in the direction of the arrow B as shown in FIG. 8A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. Meanwhile, stop state of the reel driving gear 21 is maintained by the latch spring 34 held in engagement with the reel latch 33. Therefore, only the recording paper sheet 6 is transported to a predetermined position (print starting position) in the direction of the arrow C in FIG. 7A in a stop state of the ink sheet 1.

Thereafter, the thermal head 5 is pressed against the platen roller 7 as shown in FIG. 7B. Then, when the motor 19 is rotated reversely, the capstan driving gear 18 is driven through the worm 20 in the direction of the arrow K as shown in FIG. 8B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow D as shown in FIG. 8B. At this time, the reel latch 33 is also rotated upon its disengagement from the latch spring 34. As a result, the recording paper sheet 6 is fed through a length of an image to a predetermined position in the direction of the arrow E as shown in FIG. 7B while the ink sheet 1 is being transported in the direction of the arrow c. At this time, a predetermined voltage is applied to the thermal head 5 and thus, a predetermined image in magenta is printed on the recording paper sheet 6.

Then, the thermal head 5 is retracted upwardly as shown in FIG. 7A. When the motor 19 is rotated reversely, the capstan driving gear 18 is rotated via the worm 20 in the direction of the arrow K as shown in FIG. 8B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow D in FIG. 8B. At this time, the reel latch 33 is also rotated upon its disengagement from the latch spring 34. As a result, simultaneously with feed of the recording paper sheet 6 in the direction of the arrow E in FIG. 7A, the ink sheet 1 is transported in the direction of the arrow F in FIG. 7A to a predetermined position, i.e., a leading position of the ink application portion for the ink of cyan. At this time, the predetermined position to which the ink sheet 1 should be transported is detected by the light emitting element 10 and the photosensor 11.

Then, when the motor 19 is rotated forwardly, the capstan driving gear 18 is rotated in the direction of the arrow B as shown in FIG. 8B. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. Meanwhile, stop state of the reel driving gear 21 is maintained by the latch spring 34 held in engagement with the reel latch 33. Therefore, only the recording paper sheet 6 is transported to a predetermined position (print starting position) in the direction of the arrow C in FIG. 7A in a stop state of the ink sheet 1.

Thereafter, the thermal head 5 is pressed against the platen roller 7 as shown in FIG. 7B. Then, when the motor 19 is rotated reversely, the capstan driving gear 18 is driven through the worm 20 in the direction of the arrow K as shown in FIG. 8B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow D as shown in FIG. 8B. At this time, the reel latch 33 is also rotated upon its disengagement from the latch spring 34. As a result, the recording paper sheet 6 is fed through a length of an image to a predetermined position in the direction of the arrow E as shown in FIG. 7B while the ink sheet 1 is being transported in the direction of the arrow F. At this time, a predetermined voltage is applied to the thermal head 5 and thus, a predetermined image in cyan is printed on the recording paper sheet 6.

By the above described operation, a full color image is printed on the recording paper sheet 6. Finally, the thermal head 5 is retracted upwardly as shown in FIG. 7A and the rod 25 is brought into contact with the idler lever 22 as shown in FIG. 8C such that the idler gear 23 is disengaged from the reel driving gear 21. When the motor 19 is rotated reversely in this state, the capstan driving gear 18 is rotated in the direction of the arrow K via the worm 20 as shown in FIG. 8C. Rotational force of the capstan driving gear 18 is transmitted to the idler lever 22 through frictional force produced upon contact made therebetween by urging force of the thrust imparting spring 24. The idler lever 22 is pivoted and is stopped through its contact with the rod 25. Therefore, the reel driving gear 21 and the idler gear 23 are brought out of engagement with each other. Meanwhile, stop state of the reel driving gear 21 is maintained by the latch spring 34 held in engagement with the reel latch 33. Accordingly, only the recording paper sheet 6 is transported in the direction of the arrow E as shown in FIG. 7A in a stop state of the ink sheet 1. Thus, the recording paper sheet 6 is ejected out of the image printer K2.

In the image printer K2, since the reel driving gear 21 can be rotated and stopped via the idler gear 23 by operating the idler lever 22 through frictional force produced by driving force of the capstan driving gear 18, both the ink sheet 1 and the recording paper sheet 6 can be transported by the single motor 19 acting as a driving source.

Figure 9A:
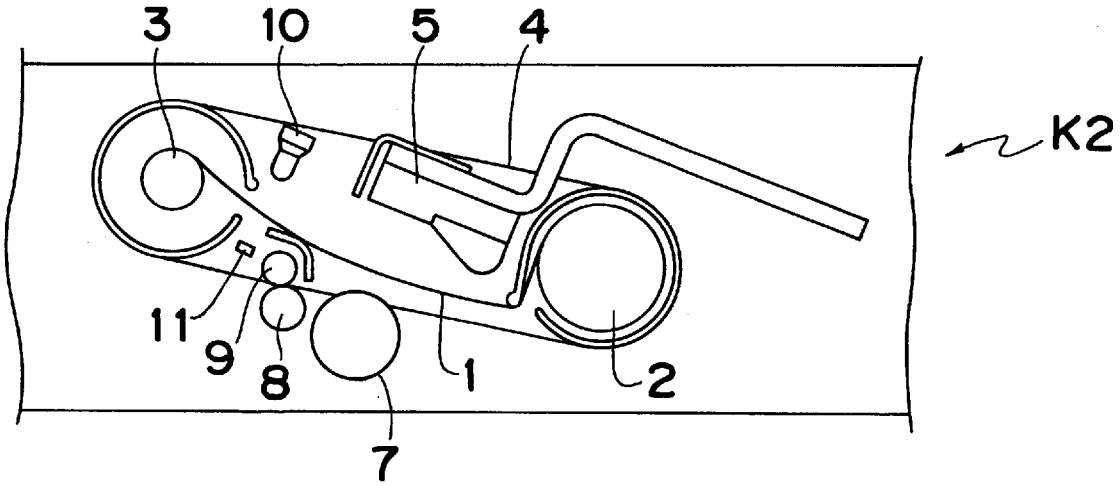
FIGS. 9A and 9B are fragmentary front elevational views of the image printer of FIG. 7A in its two operational steps, respectively.
Figure 9B:
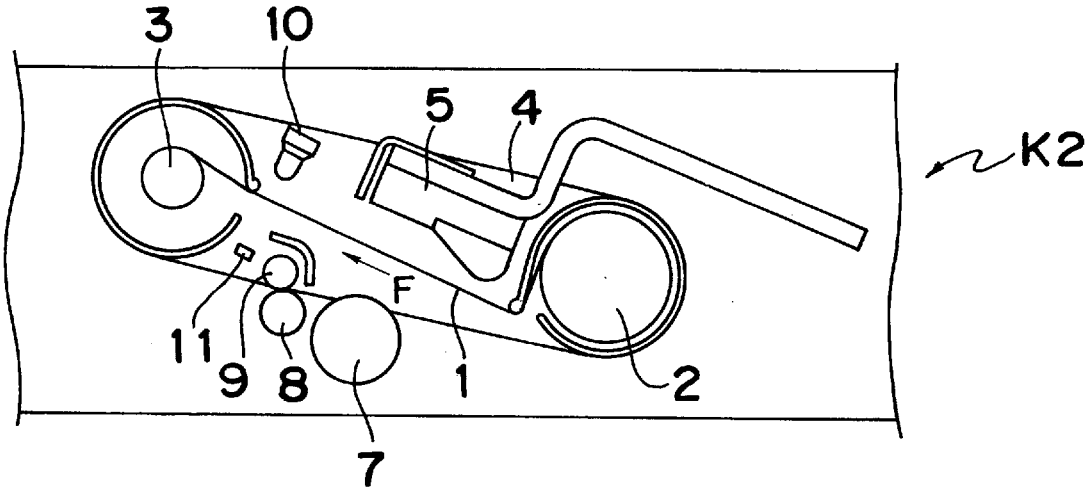

Hereinafter, another operation of the image printer K2 is described with reference to FIGS. 8A to 8C and FIGS. 9A and 9B. After completion of printing, namely, after the recording paper sheet 6 has been ejected out of the image printer K2, the thermal head 5 is retracted to a location where the ink cassette 4 can be mounted on or detached from the image printer K2 as shown in FIG. 9A, so that the ink sheet 1 is drawn outwardly by the thermal head 5 and thus, is in slack state. When the motor 25 is driven reversely in this state, the capstan driving gear 18 is rotated in the direction of arrow K as shown in FIG. 8B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow D in FIG. 8B. At this time, the reel latch 33 is also rotated upon its disengagement from the latch spring 34. As a result, since the ink sheet 1 is transported in the direction of the arrow F in FIG. 9B to a predetermined position, i.e., a leading position of the ink application portion for the ink of yellow while being subjected to positional detection of the light emitting element 10 and the photosensor 11, slack of the ink sheet 1 is eliminated.

In the image printer K2, since the light emitting element 10 and the photosensor 11 can detect positions of the ink sheet 1 regardless of position of the thermal head 5, slack of the ink sheet 1 can be eliminated without the need for providing a special slack eliminating mechanism.

Figure 10:
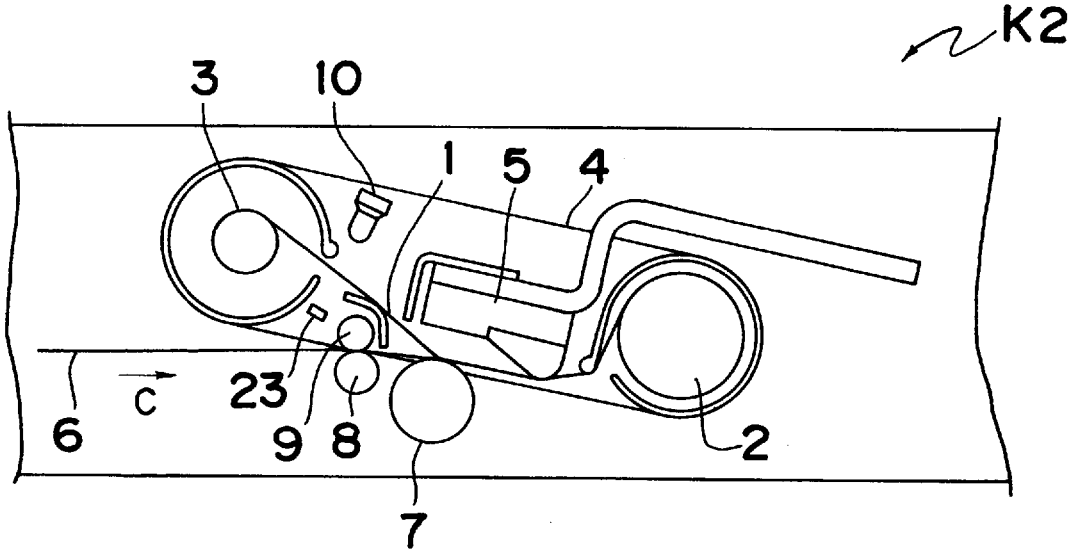
FIG. 10 is a fragmentary front elevational view of the image printer of FIG. 7A.
Figure 11A:
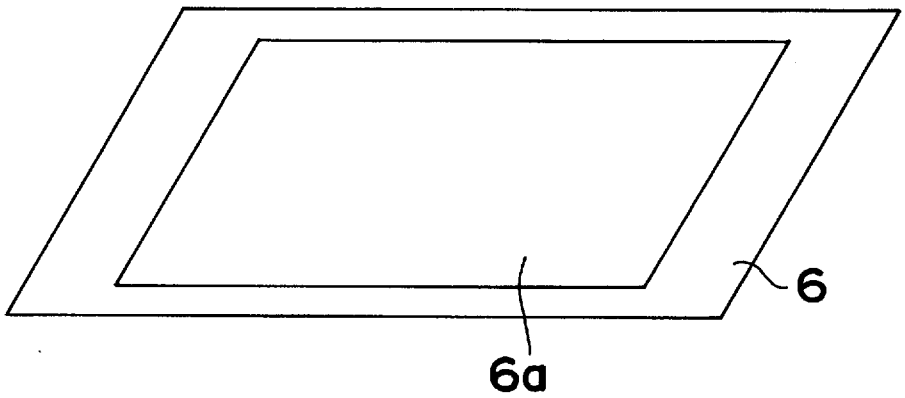
FIGS. 11A and 11B are perspective views of a recording paper sheet obtained by the image printer of FIG. 7A and a recording paper sheet of poor transfer property, respectively.
Figure 11B:
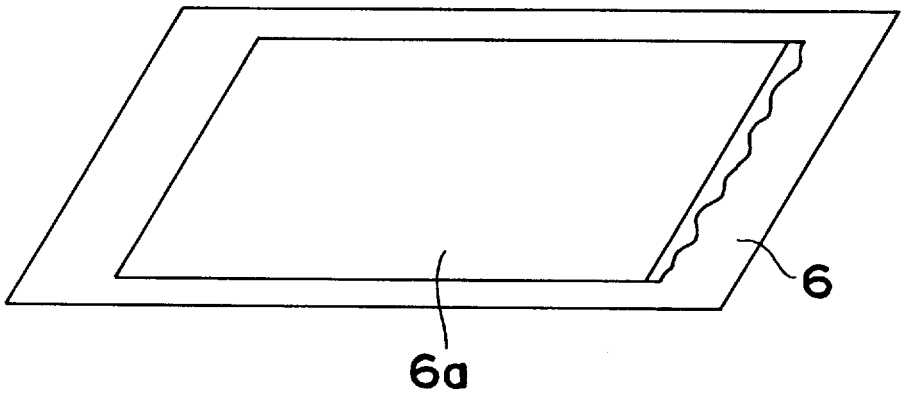

Hereinafter, the image printer K2 is further described with reference to FIGS. 10, 11A and 11B. FIG. 10 shows a front of the image printer K2, while FIG. 11A shows a recording paper sheet 6 to which a rectangular development layer 6*a* has been transferred by the image printer K2. In FIG. 10, the ink sheet 1 has the rectangular development layer 6*a* in addition to the ink application portions of the inks of three primary colors of yellow, magenta and cyan. The recording paper sheet 6 is formed by a plain paper sheet. Since the development layer 6*a* is a special coating for facilitating transfer of ink and is not formed on a printing face of the recording paper sheet 6 formed by the plain paper sheet, the inks of three primary colors are transferred to the recording paper sheet 6 after the development layer 6*a* has been provided on the ink sheet 1. FIG. 11A shows the development layer 6*a* transferred to the recording paper sheet 6.

Hereinafter, operation of the image printer K2 of the above described arrangement is described. The development layer 6*a* has a multi-layer construction and tackiness. Thus, even if the thermal head 5 is spaced away from the platen roller 7, the ink sheet 1 is held in close contact with the recording paper sheet 6. Therefore, if the thermal head 5 is spaced away from the platen roller 7 and the recording paper sheet 6 is transported through several mm in the direction of the arrow C in FIG. 11 after the development layer 6*a* has been transferred to the recording paper sheet 6, a large breaking force is produced along a line of close contact between the development layer 6*a* of the ink sheet 1 and the recording paper sheet 6 because the take-up reel 3 is locked by the reel latch 33 and the latch spring 34. As a result, the development layer 6*a* is smoothly separated from the ink sheet 1 so as to be transferred to the recording paper sheet 6 as shown in FIG. 11A. FIG. 11B shows a recording paper sheet 6 of poor transfer property in comparison with the recording paper sheet 6 of FIG. 11A.

Furthermore, the image printer K2 may be operated as follows. After completion of printing, the thermal head 5 is retracted upwardly as shown in FIG. 7A. Then, when the motor 19 is rotated forwardly, the capstan driving gear 18 is rotated via the worm 20 in the direction of the arrow B as shown in FIG. 8A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. At this time, the idler gear 23 held in engagement with the reel driving gear 21 is rotated by the capstan driving gear 18 and the idler gear 23 so as to be disengaged from the reel driving gear 21.

Subsequently, the rod 25 is displaced as shown in FIG. 8C. When the motor 19 is rotated reversely in this state, the capstan driving gear 18 is rotated via the worm 20 in the direction of the arrow K in FIG. 8C. Rotational force of the capstan driving gear 18 is transmitted to the idler lever 22 through frictional force produced upon contact made therebetween by urging force of the thrust imparting spring 24. The idler lever 22 is pivoted and is stopped through its contact with the rod 25. Therefore, the reel driving gear 21 and the idler gear 23 are brought out of engagement with each other. Meanwhile, stop state of the reel driving gear 21 is maintained by the latch spring 34 held in engagement with the reel latch 33. Accordingly, only the recording paper sheet 6 is transported in the direction of the arrow E as shown in FIG. 7A in a stable stop state of the ink sheet 1. Thus, the recording paper sheet 6 is ejected out of the image printer K2.

By the above described operation of the image printer K2, the idler gear 23 held in engagement with the reel driving gear 21 is disengaged from the reel driving gear 21 while being rotated. Therefore, in comparison with a case in which the idler gear 23 is forcibly disengaged from the reel driving gear 21 without being rotated, noises produced at the time of disengagement of the idler gear 23 from the reel driving gear 21 are reduced, damage to the idler gear 23 and the reel driving gear 21 is lessened and the idler gear 23 can be disengaged from the reel driving gear 21 quite positively.

Figure 12A:
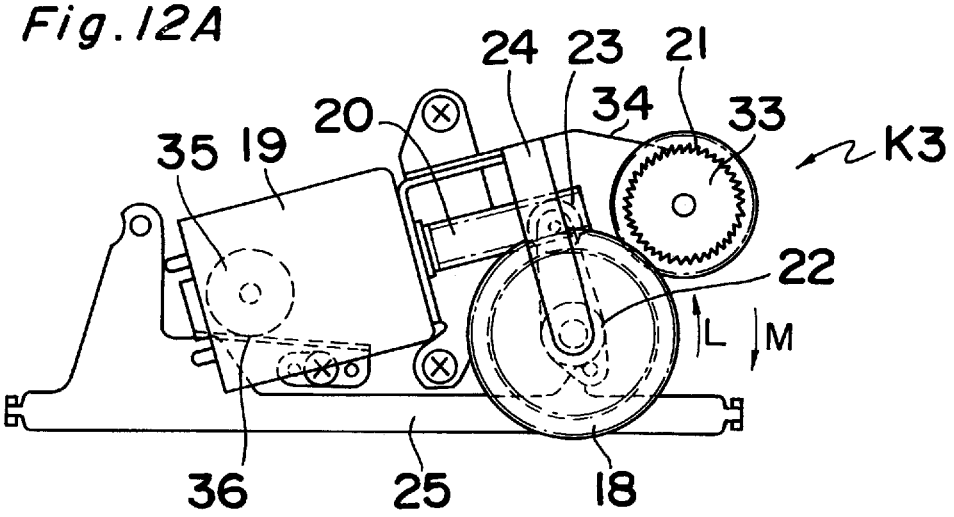
FIGS. 12A, 12B and 12C are fragmentary rear elevational views of an image printer according to a third embodiment of the present invention in its three operational steps, respectively.
Figure 12B:
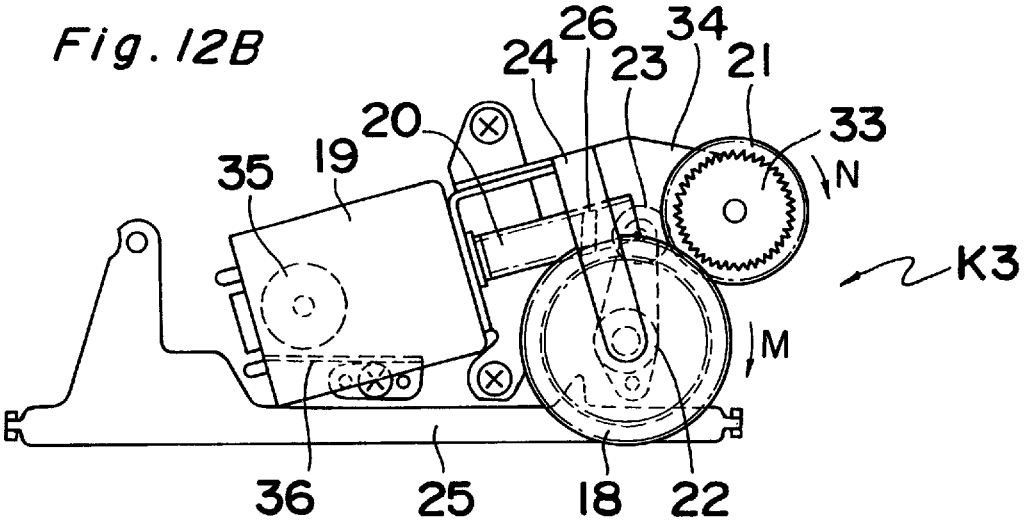
Figure 12C:
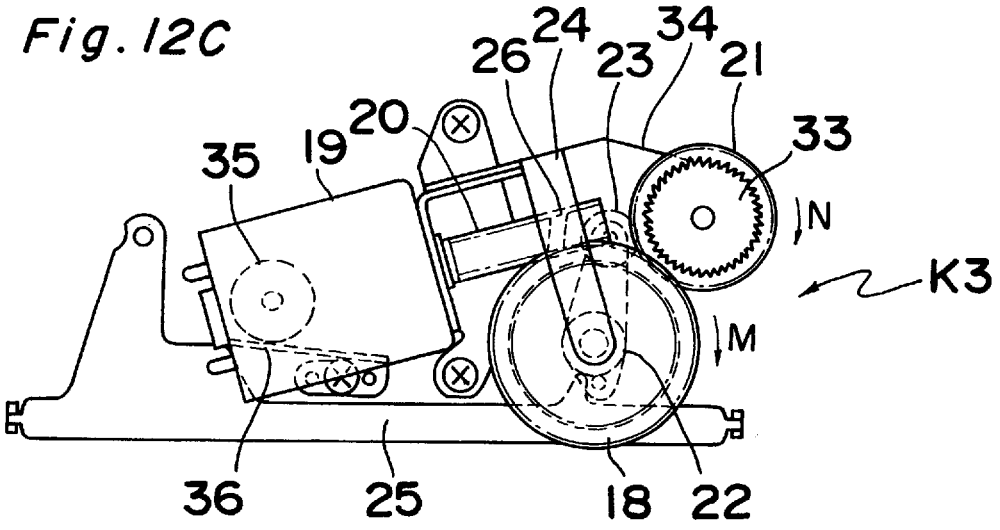

Hereinafter, an image printer K3 according to a third embodiment of the present invention is described with reference to FIGS. 12A to 12C. FIGS. 12A to 12C show a rear of the image printer K3. The image printer K3 includes a rotatable supply reel base 35 for holding the supply reel 2 and a friction spring 36 which can be brought into contact with the supply reel base 35 in response to operation of the rod 25. Since other constructions of the image printer K3 are similar to those of the image printer K2, the description is abbreviated for the sake of brevity.

Operation of the image printer K3 of the above described arrangement is described with reference to FIGS. 7A and 7B and FIGS. 12A to 12C, hereinafter. Initially, when the motor 19 is rotated forwardly in a state where the thermal head 5 is retracted upwardly as shown in FIG. 7A, the capstan driving gear 18 is rotated via the worm 20 in the direction of the arrow L as shown in FIG. 12A. Rotational force of the capstan driving gear 18 is transmitted to the idler lever 22 through frictional force produced upon contact made therebetween by urging force of the thrust imparting spring 24. Thus, the idler lever 22 is pivoted and is stopped at the stopper 26. At this time, the friction spring 36 is brought into contact with an outer periphery of the supply reel base 35 at a predetermined pressure by the rod 25 so as to maintain stop state of the supply reel base 35. Meanwhile, stop state of the reel driving gear 21 is maintained by the latch spring 34 held in engagement with the reel latch 33. Therefore, only the recording paper sheet 6 is transported to a predetermined position in the direction of the arrow C as shown in FIG. 7A in a stable stop state of the ink sheet 1.

Subsequently, when the motor 19 is rotated reversely, the capstan driving gear 18 is rotated via the worm 20 in the direction of the arrow M as shown in FIG. 12B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow N in FIG. 12B. At this time, the reel latch 33 is also rotated upon its disengagement from the latch spring 34. Meanwhile, the friction spring 36 is spaced away from the supply reel base 35. As a result, simultaneously with feed of the recording paper sheet 6 in the direction of the arrow E in FIG. 7A, the ink sheet 1 is transported, without any backward tension being applied thereto by the friction spring 36, in the direction of the arrow F in FIG. 7A to a predetermined position, i.e., a leading position of the ink application portion for the ink of yellow. At this time, the predetermined position to which the ink sheet 1 should be transported is detected by the light emitting element 10 and the photosensor 11.

Then, when the motor 19 is rotated forwardly, the capstan driving gear 18 is rotated in the direction of the arrow L as shown in FIG. 12A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. At this time, the friction spring 36 is brought into contact with the outer periphery of the supply reel base 35 at a predetermined pressure by the rod 25 so as to maintain stop state of the supply reel base 35. Meanwhile, stop state of the reel driving gear 21 is maintained by the latch spring 34 held in engagement with the reel latch 33. Therefore, only the recording paper sheet 6 is transported to a predetermined position (print starting position) in the direction of the arrow C in FIG. 7A in a stable stop state of the ink sheet 1.

Thereafter, the thermal head 5 is pressed against the platen roller 7 as shown in FIG. 7B. Then, when the motor 19 is rotated reversely, the capstan driving gear 18 is driven through the worm 20 in the direction of the arrow M as shown in FIG. 12C. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow N as shown in FIG. 12C. At this time, the reel latch 34 is also rotated upon its disengagement from the latch spring 34. Meanwhile, the friction spring 36 is brought into contact with the outer periphery of the supply reel base 35 at a predetermined pressure by the rod 25 so as to produce a predetermined load torque on the supply reel base 35. As a result, the recording paper sheet 6 is fed through a length of an image to a predetermined position in the direction of the arrow E as shown in FIG. 7A while the ink sheet 1 is being transported in the direction of the arrow F with a predetermined backward tension being applied to the ink sheet 1 by the friction spring 36. At this time, a predetermined voltage is applied to the thermal head 5 and thus, a predetermined image in yellow is printed on the recording paper sheet 6.

Then, the thermal head 5 is retracted upwardly as shown in FIG. 7A. When the motor 19 is rotated reversely, the capstan driving gear 18 is rotated via the worm 20 in the direction of the arrow M as shown in FIG. 12B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow N in FIG. 12B. At this time, the reel latch 33 is also rotated upon its engagement from the latch spring 34. Meanwhile, the friction spring 36 is spaced away from the supply reel base 35. As a result, simultaneously with feed of the recording paper sheet 6 in the direction of the arrow E in FIG. 7A, the ink sheet 1 is transported, without any backward tension being applied thereto by the friction spring 36, in the direction of the arrow E in FIG. 7A to a predetermined position, i.e., a leading position of the ink application portion for the ink of magenta. At this time, the predetermined position to which the ink sheet 1 should be transported is detected by the light emitting element 10 and the photosensor 11.

Then, when the motor 19 is rotated forwardly, the capstan driving gear 18 is rotated in the direction of the arrow L as shown in FIG. 12A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. At this time, the friction spring 36 is brought into contact with the outer periphery of the supply reel base 35 at a predetermined pressure by the rod 25 so as to maintain stop state of the supply reel base 35. Meanwhile, stop state of the reel driving gear 21 is maintained by the latch spring 34 held in engagement with the reel latch 33. Therefore, only the recording paper sheet 6 is transported to a predetermined position (print starting position) in the direction of the arrow C in FIG. 7A in a stable stop state of the ink sheet 1.

Thereafter, the thermal head 5 is pressed against the platen roller 7 as shown in FIG. 7B. Then, when the motor 19 is rotated reversely, the capstan driving gear 18 is driven through the worm 20 in the direction of the arrow M as shown in FIG. 12C. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow N as shown in FIG. 12C. At this time, the reel latch 33 is also rotated upon its disengagement from the latch spring 34. Meanwhile, the friction spring 36 is brought into contact with the outer periphery of the supply reel base 35 at a predetermined pressure by the rod 25 so as to produce a predetermined load torque on the supply reel base 35. As a result, the recording paper sheet 6 is fed through a length of an image to a predetermined position in the direction of the arrow E as shown in FIG. 7B while the ink sheet 1 is being transported in the direction of the arrow c with a predetermined backward tension being applied to the ink sheet 1 by the friction spring 36. At this time, a predetermined voltage is applied to the thermal head 5 and thus, a predetermined image in magenta is printed on the recording paper sheet 6.

Then, the thermal head 5 is retracted upwardly as shown in FIG. 7A. When the motor 19 is rotated reversely, the capstan driving gear 18 is rotated via the worm 20 in the direction of the arrow M as shown in FIG. 12B. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow N in FIG. 12B. At this time, the reel latch 33 is also rotated upon its disengagement from the latch spring 34. Meanwhile, the friction spring 36 is spaced away from the supply reel base 35. As a result, simultaneously with feed of the recording paper sheet 6 in the direction of the arrow E in FIG. 7A, the ink sheet 1 is transported, without any backward tension being applied thereto by the friction spring 36, in the direction of the arrow F in FIG. 7A to a predetermined position, i.e., a leading position of the ink application portion for the ink of cyan. At this time, the predetermined position to which the ink sheet 1 should be transported is detected by the light emitting element 10 and the photosensor 11.

Then, when the motor 19 is rotated forwardly, the capstan driving gear 18 is rotated in the direction of the arrow L as shown in FIG. 12A. Rotational force of the capstan driving gear 18 is transmitted to the idler lever 22 through frictional force produced upon contact made therebetween by urging force of the thrust imparting spring 24. Then, the idler lever 22 is pivoted and is stopped at the stopper 26. At this time, the friction spring 36 is brought into contact with the outer periphery of the supply reel base 35 at a predetermined pressure by the rod 25 so as to maintain stop state of the supply reel base 35. Meanwhile, stop state of the reel driving gear 21 is maintained by the latch spring 34 held in engagement with the reel latch 33. Therefore, only the recording paper sheet 6 is transported to a predetermined position (print starting position) in the direction of the arrow C in FIG. 7A in a stable stop state of the ink sheet 1.

Thereafter, the thermal head 5 is pressed against the platen roller 7 as shown in FIG. 7B. Then, when the motor 19 is rotated reversely, the capstan driving gear 18 is driven through the worm 20 in the direction of the arrow M as shown in FIG. 12C. Rotational force of the capstan driving gear 18 is transmitted to the idler lever 22 through frictional force produced upon contact made therebetween by urging force of the thrust imparting spring 24. Thus, the idler lever 22 is pivoted and is stopped at a position where the reel driving gear 21 and the idler gear 23 are brought into engagement with each other. Meanwhile, the reel driving gear 21 is rotated in the direction of the arrow N as shown in FIG. 12C. At this time, the reel latch 33 is also rotated upon its disengagement from the latch spring 34. Meanwhile, the friction spring 36 is brought into contact with the outer periphery of the supply reel base 35 at a predetermined pressure by the rod 25 so as to produce a predetermined load torque on the supply reel base 35. As a result, the recording paper sheet 6 is fed through a length of an image to a predetermined position in the direction of the arrow E as shown in FIG. 7A while the ink sheet 1 is being transported in the direction of the arrow F with a predetermined backward tension being applied to the ink sheet 1 by the friction spring 36. At this time, a predetermined voltage is applied to the thermal head 5 and thus, a predetermined image in cyan is printed on the recording paper sheet 6.

By the above described operation, a full color image is printed on the recording paper sheet 6. Finally, the thermal head 5 is retracted upwardly as shown in FIG. 7A and the rod 25 is brought into contact with the idler lever 22 as shown in FIG. 12A such that the idler gear 23 is disengaged from the reel driving gear 21. When the motor 19 is rotated reversely in this state, the capstan driving gear 18 is rotated in the direction of the arrow M via the worm 20 as shown in FIG. 12A. Rotational force of the capstan driving gear 18 is transmitted to the idler lever 22 through frictional force produced upon contact made therebetween by urging force of the thrust imparting spring 24. The idler lever 22 is pivoted and is stopped through its contact with the rod 25. Therefore, the reel driving gear 21 and the idler gear 23 are brought out of engagement with each other. At this time, the friction spring 36 is brought into contact with the outer periphery of the supply reel base 35 at a predetermined pressure by the rod 25 so as to maintain stop state of the supply reel base 35.

Meanwhile, stop state of the reel driving gear 21 is maintained by the latch spring 34 held in engagement with the reel latch 33. Accordingly, only the recording paper sheet 6 is transported in the direction of the arrow E as shown in FIG. 7A in a stable stop state of the ink sheet 1. Thus, the recording paper sheet 6 is ejected out of the image printer K3.

In the image printer K3, since the reel driving gear 21 can be rotated and stopped via the idler gear 23 by operating the idler lever 22 through frictional force produced by driving force of the capstan driving gear 18, both the ink sheet 1 and the recording paper sheet 6 can be transported by the single motor 19 acting as a driving source. In addition, by bringing the friction spring 36 into and out of contact with the supply reel base 35, back tension corresponding to operation can be applied to the ink sheet 1, so that the ink sheet 1 can be fed and held stably.

As will be clear from the foregoing description of the image printer of the present invention, since only one motor 19 is capable of acting as not only a driving source for transporting the ink sheet 1 but a driving source for transporting the recording paper sheet 6, one motor which is expensive and bulky can be eliminated, so that the image printer can be made compact and light and can be produced at low cost.

What is claimed is:

1. An image printer comprising:

a printing means for printing dye on a recording medium;

a dye medium take-up means for taking up a dye medium to which the dye is applied;

a first power transmission means for transmitting power to the dye medium take-up means;

a recording medium transporting means for transporting the recording medium;

a drive means for driving the dye medium take-up means and the recording medium transporting means, which can be driven forwardly and reversely;

a pivotal means which is pivotal in response to rotation of the recording medium transporting means;

a second power transmission means for transmitting power from the recording medium transporting means to the first power transmission means, which is mounted on the pivotal means;

an urging means for bringing the recording medium transporting means into contact with the pivotal means so as to transmit driving force of the recording medium transporting means to the pivotal means; and a preventive means for selectively preventing the second power transmission means from coming into contact with the first power transmission means;

wherein when the drive means is driven in a first direction, driving force of the drive means is transmitted to the recording medium transporting means so as to not only transport the recording medium in a first direction but pivot the pivotal means towards the first power transmission means through the recording medium transporting means, whereby the second power transmission means is brought into contact with the first power transmission means so as to drive the dye medium take-up means by power of the drive means such that the dye medium is taken up by the dye medium take-up means;

wherein when the drive means is driven in a second direction, driving force of the drive means is transmitted to the recording medium transporting means so as to not only transport the recording medium in a second direction but pivot the pivotal means away from the first power transmission means through the recording medium transporting means, whereby the second power transmission means is spaced away from the first power transmission means such that the dye medium take-up means is not driven.

2. An image printer comprising:

a printing means for printing dye on a recording medium;

a dye medium take-up means for taking up a dye medium to which the dye is applied;

a first power transmission means for transmitting power to the dye medium take-up means;

a recording medium transporting means for transporting the recording medium;

a drive means for driving the dye medium take-up means and the recording medium transporting means, which can be driven forwardly and reversely;

a pivotal means which is pivotal in response to rotation of the recording medium transporting means;

a second power transmission means for transmitting power from the recording medium transporting means to the first power transmission means, which is mounted on the pivotal means;

an urging means for bringing the recording medium transporting means into contact with the pivotal means so as to transmit driving force of the recording medium transporting means to the pivotal means;

a first preventive means for selectively preventing the second power transmission means from coming into contact with the first power transmission means; and a second preventive means for preventing the first power transmission means from being moved in a direction to opposite to a direction of take-up of the dye medium;

wherein when the drive means is driven in a first direction, driving force of the drive means is transmitted to the recording medium transporting means so as to not only transport the recording medium in a first direction but pivot the pivotal means towards the first power transmission means through the recording medium transporting means, whereby the second power transmission means is brought into contact with the first power transmission means so as to drive the dye medium take-up means by power of the drive means such that the dye medium is taken up by the dye medium take-up means;

wherein when the drive means is driven in a second direction, driving force of the drive means is transmitted to the recording medium transporting means so as to not only transport the recording medium in a second direction but pivot the pivotal means away from the first power transmission means through the recording medium transporting means, whereby the second power transmission means is spaced away from the first power transmission means such that the dye medium take-up means is not driven.

3. An image printer as claimed in claim 2, further comprising:

a braking force generating means for producing frictional braking force in response to operation of the first preventive means, which is provided on a dye medium supply means.

4. An image printer as claimed in claim 2, further comprising:

a detection means for detecting, in a state where the printing means is retracted and a housing containing the dye medium can be mounted on or detached from the image printer, respective leading edges of colors of the dye medium such that the dye medium is transported to a predetermined position.

* * * * *